US006958010B1

(12) United States Patent
Reese

(10) Patent No.: US 6,958,010 B1
(45) Date of Patent: Oct. 25, 2005

(54) CRAWL SPACE VENTILATION SYSTEM

(75) Inventor: Timothy A. Reese, Greenville, SC (US)

(73) Assignee: TB&B Partners, Greer, SC (US)

( * ) Notice: Subject to any disclaimer, the term of this patent is extended or adjusted under 35 U.S.C. 154(b) by 0 days.

(21) Appl. No.: 10/973,960

(22) Filed: Oct. 26, 2004

Related U.S. Application Data

(63) Continuation-in-part of application No. 10/829,634, filed on Apr. 22, 2004.

(51) Int. Cl.[7] ..... F24F 7/007
(52) U.S. Cl. ..... 454/239; 236/44 C; 454/251; 454/256; 454/338
(58) Field of Search ..... 454/239, 251, 454/252, 253, 256, 338; 236/44 C, 49.3, 236/49.5

(56) References Cited

U.S. PATENT DOCUMENTS

| | | | | |
|---|---|---|---|---|
| 3,368,756 A | | 2/1968 | Edwards | 236/49 |
| 3,575,641 A | | 4/1971 | Long et al. | 317/153 |
| 4,665,351 A | | 5/1987 | Nyberg | 318/483 |
| 4,702,149 A | | 10/1987 | Speer | |
| 4,829,882 A | | 5/1989 | Jackson | |
| 4,877,182 A | | 10/1989 | Pugh et al. | 236/44 C |
| 5,253,804 A | * | 10/1993 | Sarazen et al. | 236/44 C |
| 5,626,288 A | * | 5/1997 | Huber | 236/49.3 |
| 6,468,054 B1 | * | 10/2002 | Anthony et al. | 417/360 |
| 2003/0190885 A1 | * | 10/2003 | Johnsons, Jr. | 454/186 |

* cited by examiner

*Primary Examiner*—Harold Joyce
(74) *Attorney, Agent, or Firm*—Robert R. Reed

(57) ABSTRACT

A fan unit centrally located within a crawl space includes a fan, a fan motor, an inlet grill, and an outlet grill. A timer connected in the power supply activates the fan motor at periodic predetermined time intervals to move the crawl space air through the fan unit. The fan unit is located and orientated to create a negative pressure to pull air into the crawl space through wall inlet vents and to also create a positive pressure to force air out of the crawl space through wall outlet vents. An outside humidity sensor can be used to insure the outside air has a lower percent humidity than that desired in the crawl space and an inside humidity sensor is used to turn the fan unit off if the crawl space humidity is below an acceptable limit. A temperature sensor is used to turn the fan unit off when the crawl space air temperature gets too low.

17 Claims, 6 Drawing Sheets

CRAWL SPACE VENTILATION SYSTEM

This is a Continuation-in-part of application Ser. No. 10/829,634, filed Apr. 22, 2004.

BACKGROUND OF THE INVENTION

This invention is directed to providing ventilation for a crawl space under a house or similar structure, and in particular to provide a fan system for the introduction of air into and from the crawl space as well as circulation within the crawl space to reduce the amount of moisture present in the crawl space.

The moisture content within a crawl space is the result of having a space between the ground and the floor that is subjected to a moisture buildup from various sources. Some of these sources include leaking pipes, condensation on the exterior surfaces of heating and air conditioning ducts and natural ground water intrusion into the crawl space. Very little opportunity exists for the moisture to be discharged from the crawl space. Openings in the exterior walls are generally small and not properly located to keep the moisture content of the crawl space air from reaching a high percentage. The need exists to provide a positive flow of the air not only within the crawl space but also from a source having a lower percentage of moisture introduced into the crawl space and discharging the air within the crawl space having a high percentage of moisture.

The lack of circulation or movement of air within a crawl space results in higher concentrations of radon gas and the inability of the air to carry moisture from the crawl space that has evaporated into the air from damp surfaces. The harmful effects of radon gas are well known in the building industry and special construction features are used to keep concentrations low, including a ground cover, vent pipes and crawl space vents. In addition, air moving across a moist surface will collect moisture from the surface by evaporation from the surface and transport this excess moisture in the air away from the surface. The better the air circulation the more moisture will be removed from the crawl space by evaporation. This moisture reducing effect is in addition to replacing air having a high percentage of moisture with air having a lower percent moisture as previously discussed.

Some of the bad effects of high moisture content in the crawl space air include wood rot, mold, mildew, fungi, bacteria growth and insect infestation, to mention a few. The crawl space air can have an odor which is also objectionable. Radon gas content of a crawl space having a high moisture content is generally found to be higher than that in a crawl space with a low moisture content. A lower moisture content air of a crawl space has many advantages including: helping prevent termite infestation; helping prevent rusting and corrosion of heating and air conditioning equipment; helping maintain floor insulation "R" factors; and helping prevent high moisture content air from reaching the living space in a home.

Typical crawl space ventilation systems have been disclosed in U.S. Pat. Nos. 3,368,756; 4,702,149; 4,829,882; and 4,877,182. The ventilator systems of '756 and '149 are passive systems where the air is not being forced through the crawl space and depends on the natural flow as a result of temperature differences. The ventilation systems of '182 and '882 depend on both intake and exhaust units at the exterior openings and vents of the crawl space. Numerous dehumidification systems are available in the industry to actively remove moisture from a space to reduce the moisture content of the air. These systems are generally used to condition the living area air and are not cost effective for use in conditioning air in a crawl space.

The need remains to have an efficient and cost effective ventilation system for the crawl space under the lower floor of a home or building not built on the ground. The ventilation system should be easy to install as an aftermarket device.

Accordingly, an object of the present invention is to provide a ventilation system for a home or building crawl space which is easily installed and operated but effective in reducing the moisture content of the air within the crawl space.

An additional object of the present invention is to provide air circulation within a crawl space that reduces the concentration of radon gas and helps reduce the moisture in the crawl space by removing moist air caused by evaporation from damp surfaces.

Another object of the present invention is to provide a high velocity and high cubic feet per minute ventilating system which is cost effective to produce, install and operate.

A further object of the present invention is to provide a control system which operates with limited changes and can be set to provide the low moisture content air for the crawl space.

Yet another object of the present invention is to provide a crawl space ventilation system that accounts for the relative humidity of the crawl space compared with the ambient air and the crawl space temperature.

SUMMARY OF THE INVENTION

The above objectives are accomplished according to the present invention by a combination of a fan unit suspended from the building floor structure within the crawl space. The fan unit includes a fan, a fan motor an inlet grill and an outlet grill. A timer connected to the power supply activates the fan motor at periodic predetermined time intervals to move the crawl space air through the fan unit. The fan unit is located and orientated to create a negative pressure to pull air into the crawl space through inlet vents and to also create a positive pressure to force air out of the crawl space through outlet vents. Inlet and outlet vents are located in the exterior walls of the crawl space and generally exist in most homes and buildings without adding any new vents. The location and orientation of the fan unit determines which existing vents become inlet vents and which become outlet vents depending on positive and negative pressures created within the crawl space by the fan unit. The wind direction exterior to the crawl space can also influence which vents are inlet vents and which become outlet vents. However, during certain periods of time, the moisture in the outside air may be too high. An outside humidity sensor can be used to insure the outside air has a lower percent humidity than that desired in the crawl space before the fan motor is activated. A temperature sensor is also used to help protect the system from freezing conditions which may cause ice to form in the crawl space.

In one embodiment of the present invention an electrically powered ventilation system is provided for a building crawl space to reduce the moisture content of enclosed air within walls of the crawl space. The system comprises a fan unit having a fan operated by an electrical motor. The fan unit is centrally located and orientated within the crawl space and includes at least one inlet grill and an outlet grill for moving air within the crawl space through said fan unit to establish high and low air pressure areas within the crawl space relative to the outside ambient air pressure. Inlet vents in the walls, adjacent to low air pressure areas allow for movement of relatively low moisture content outside ambient air into the crawl space. Outlet vents in the walls, adjacent to high pressure areas allow for movement of relatively higher moisture content crawl space air to be forced from the crawl space. A timer unit is manually set to transmit a first electrical signal to activate the fan unit for periodic ventilation time periods that are set to optimally reduce the moisture content of the crawl space air. A controller unit having a control switch is connected between the timer unit and the fan unit to turn the fan unit on and off. A main switch of the controller unit is for directly transmitting electrical power to said control switch to turn on said fan unit in one position, and to activate control logic circuits for air temperature and humidity controls before selectively transmitting electrical power to said control switch to turn on said fan unit in the other position.

In one aspect of the invention a transformer of the controller unit provides a low voltage signal. A crawl space temperature sensor is powered by said low voltage signal to sense the crawl space temperature and transmit a temperature signal to indicate the crawl space temperature. A temperature control logic circuit of said controller unit receives both said low voltage signal and said temperature signal, wherein said low voltage signal is transmitted directly to said control switch to turn the fan motor off when said temperature signal is below a predetermined temperature value.

In another aspect of the invention an outside humidity sensor is powered by the low voltage signal to sense the percent moisture content of the outside ambient air and transmit a second electrical signal to indicate the outside air humidity. A first control logic circuit of said controller unit receives both the low voltage signal and the second electrical signals, wherein the low voltage signal is transmitted directly to the control switch to turn the fan motor off when the outside humidity is above a first threshold value. An inside crawl space humidity sensor is powered by said low voltage signal to sense the percent moisture content of the inside crawl space air and transmit a third electrical signal to indicate the inside crawl space air humidity. A second control logic circuit of the controller unit receives both the low voltage signal and the third electrical signal. The low voltage signal is transmitted directly to the control switch to turn the fan motor on when the inside crawl space humidity is above a second threshold value and to turn the fan motor off when the inside crawl space air humidity is below a second threshold value.

In another embodiment of the invention a multiple ventilation system is provided for multiple crawl spaces under a building structure with exterior wall vents to reduce the moisture content of the air within at least one crawl space. The multiple ventilation system comprises a fan unit having a fan operated by an electrical motor. The fan unit is centrally located and orientated within the one crawl space. A timer unit associated with fan unit that is set to transmit a first electrical signal for ventilation time periods that are determined to optimally reduce the moisture content of the air in the one crawl space. A temperature sensor to determine a temperature within the one crawl space and transmit a temperature electrical signal that indicates a temperature value in the crawl space is used to determine if the fan unit should be activated. An outside humidity sensor determines the percent moisture value of the ambient air and generates a second electrical signal to indicate the ambient air moisture value to further determine if the fan unit should be activated. An inside humidity sensor determines the percent moisture value of the one crawl space air and generate a third electrical signal to indicate a percent moisture value for the at least one crawl space air to help determine if the fan unit should be activated. A controller unit associated with each crawl space includes a main switch, a transformer, a plurality of logic control circuits and a control switch. The controller unit receives the temperature signal, second and third electrical signals and compares these signals with predetermined limits of temperature and humidity. The fan unit may be one of either activated or turned off by comparing the signals with the predetermined limits.

In another aspect of the present invention, ventilation of another crawl space of the building is realized. A remote ventilation system comprises a duct extending from said discharge plenum of the fan unit in the one crawl space into the remote crawl space. A portion of the discharge air from the adjacent fan unit is diverted and discharged into the remote crawl space to produce an increase in the air pressure within the remote crawl space. The relatively high moisture content of the air within the remote crawl space is exhausted to the exterior of the remote crawl space through the wall vents in the remote crawl space.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1A:
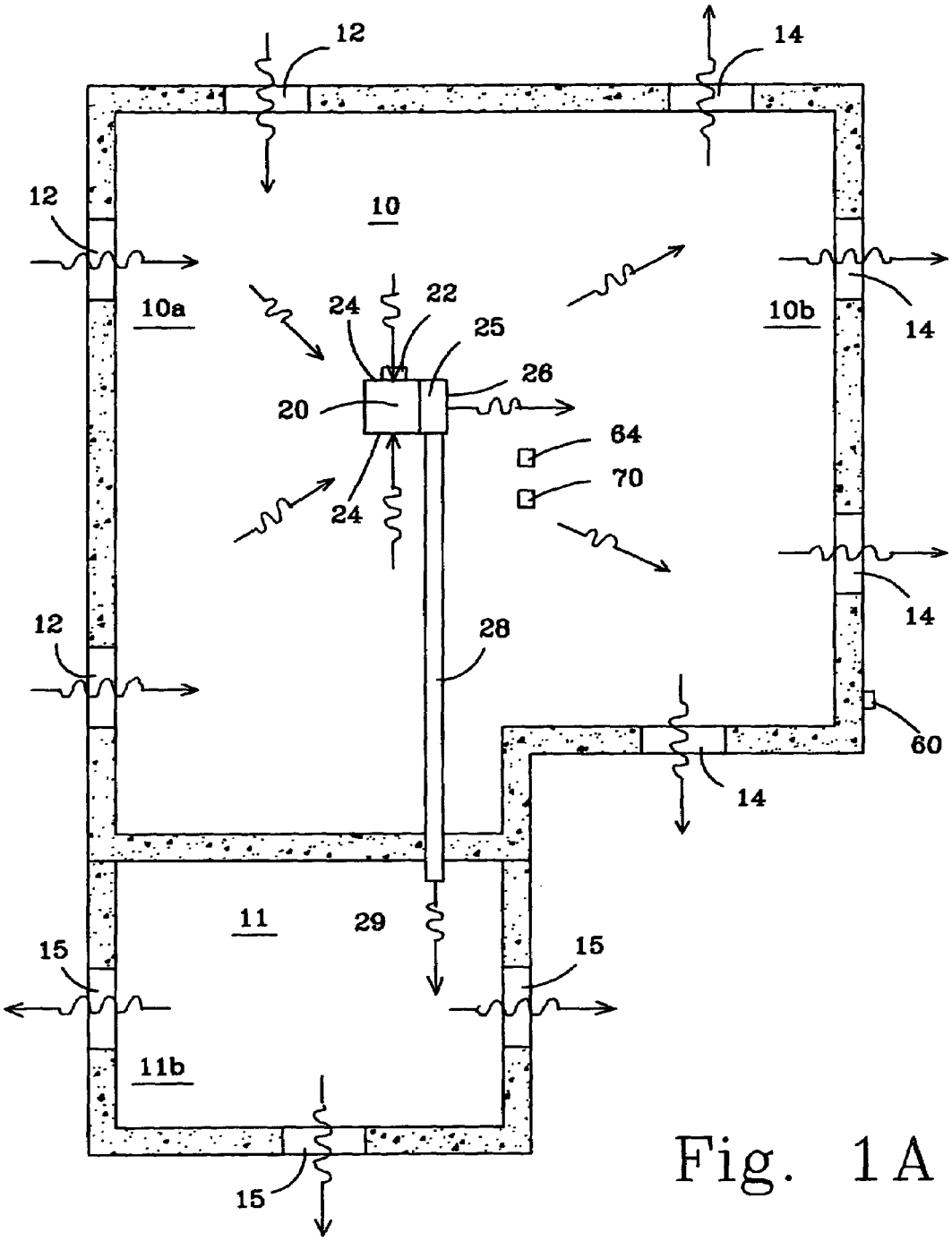
FIG. 1A is a plan view of typical crawl spaces between a floor structure and the ground surface within walls of a building having a fan unit centrally located in one crawl space to discharge air in one direction to draw outside air into the crawl space through inlet vents and discharge air through outlet vents to provide ventilation for the crawl spaces.
Figure 1B:
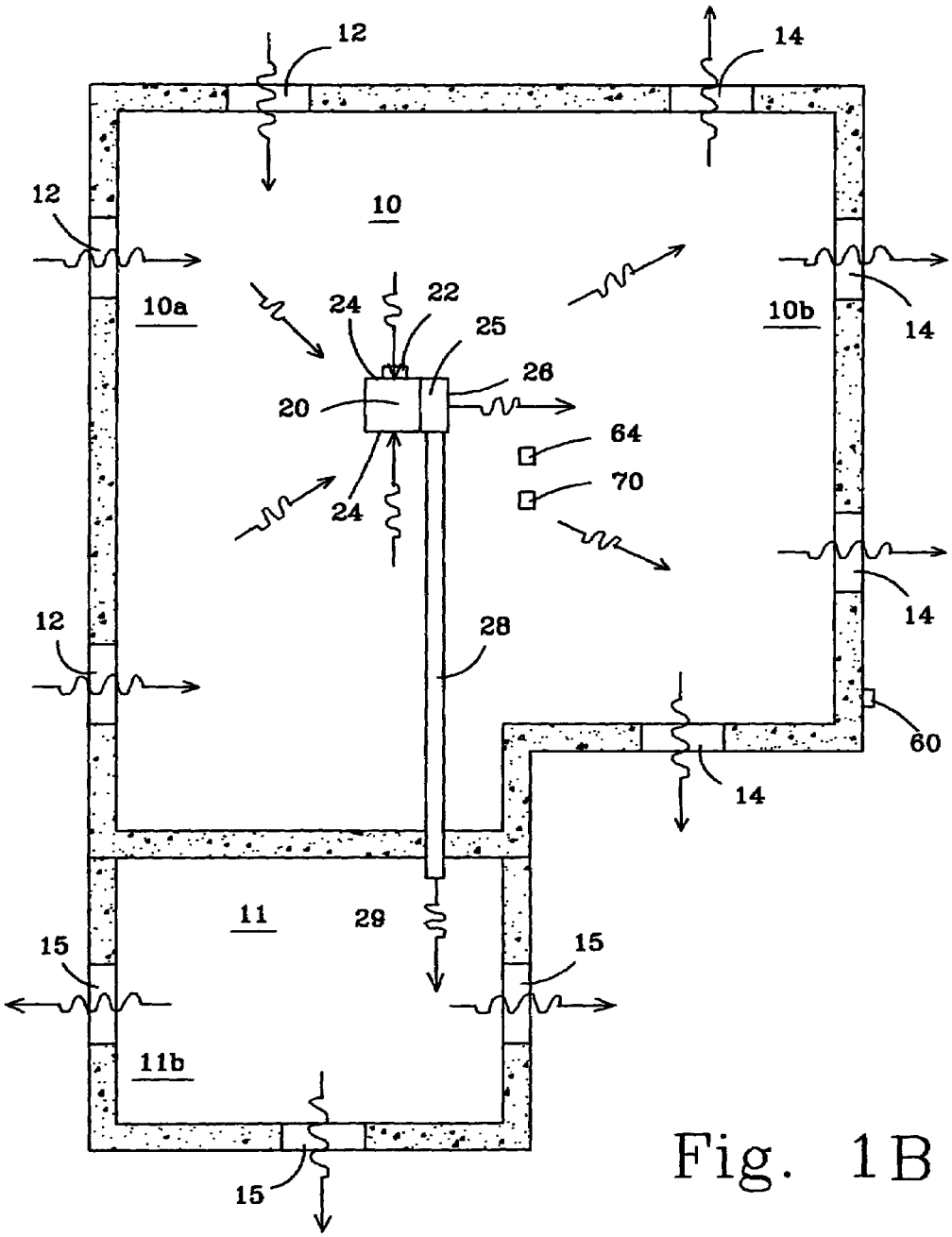
FIG. 1B is a plan view of the typical crawl spaces between a floor structure and the ground surface within walls of the building of FIG. 1 having the fan unit again centrally located in the one crawl space but reversed to discharge air in an opposite direction and draw outside air into the crawl space through different inlet vents and discharge air through different outlet vents to again provide ventilation for the crawl spaces.

Referring now to the drawings, the invention will now be described in more detail. A fan unit 20 is positioned within a crawl space 10 at a somewhat central location within the crawl space area, as illustrated in FIGS. 1A and 1B. The fan unit includes a fan motor 22, inlet grills 24, a discharge plenum 25 and an outlet grill. The fan unit is located and orientated to pull air into the crawl space through inlet vents 12 and force air out of the crawl space through outlet vents 14. Inlet and outlet vents are located in exterior walls 18 of crawl space 10 and generally exist in most homes and buildings and usually include a screen or grill and a hinged cover for closing the vent when ventilation of the crawl space is not wanted or needed. These vents normally exist in buildings to obtain natural or free ventilation of the crawl space. The location and orientation of fan unit 20 determines which existing vents become inlet vents and which become outlet vents; depending on negative pressure locations 10*a* created within the crawl space adjacent inlet vents and positive pressure locations 10*b* created within the crawl space adjacent outlet vents. The wind direction exterior to the crawl space can also influence which vents are inlet vents and which become outlet vents. The plan view of FIG. 1A shows fan unit 20 discharging air in an opposite direction to that shown in FIG. 1B. In this case the location on inlet vents 12 and outlet vents 14 has changed. The essential operation is to draw an equal quantity of air into the crawl space as there is being discharged from the crawl space. According to the present invention it is not important which vents become inlet vents and which become outlet vents as long as a flow and circulation of air is maintained to achieve more changes of air in the crawl space per unit of time compared with the crawl space having no fan unit. The serpentine arrows of FIGS. 1A and 1B illustrate a possible direction of the flow of air within the crawl space as well as in and out of the crawl space.

A remote crawl space area 11 may exist which is separated from the main crawl space 10. For these remote areas a duct 28 is provided as illustrated in FIGS. 1A and 1B. The duct connects to discharge plenum 25 with vanes in the discharge plenum to direct air into the duct. Air is discharged into the remote area from an end 29 of the duct to increase the pressure in the remote area. This higher than ambient pressure moves the air in the remote area out through outlet vents 15 to the outside. Additional remote areas can be ventilated in the same way.

The overall objective is to circulate air in crawl space and reduce the moisture content of the crawl space air by moving the air within the crawl space and replacing the air within the crawl space. Therefore, it is necessary to pull air into the crawl space that has a lower moisture content than the air within the crawl space without ventilation. One aspect of the crawl space ventilation system of this invention depends on the outside ambient air having a lower moisture content. An outside humidity sensor 60 is included to monitor the percent moisture of the outside ambient air. If the outside ambient air has a higher moisture content than the inside crawl space air, little or no advantage is achieved by bringing outside air into the crawl space. In addition, an inside humidity sensor 64 is included to monitor the percent moisture in the crawl space air. If the crawl space air already has a low moisture content, the crawl space moisture is under control and there is also little or no advantage in bringing outside air into the crawl space. However, the movement of air for evaporation of moisture from damp surfaces and the lowering of radon gas concentrations may continue to yield positive results, regardless of the inside or outside humidity.

Another aspect of the crawl space ventilation system of this invention depends on the crawl space temperature having a lower value than a predetermined value for safe operation of the system. A crawl space temperature sensor 70 is included to monitor the temperature of the inside crawl space air. If the crawl space temperature is below a predetermined value that creates a problem in operating components within the crawl space that are damaged by a low temperatures, such as ice buildup, the ventilation system can be turned off. The temperature sensor transmits a temperature signal that can be compared with the predetermined value to decide if continued operation of the ventilation system is desirable.

The ventilation system of this invention has the option of using or not using the inside and outside air humidity values and the crawl space temperature value to operate the fan unit. The humidity and temperature sensors are those commonly found in the building industry to measure percent moisture and temperature and transmit a proportional electrical signal.

Figure 2A:
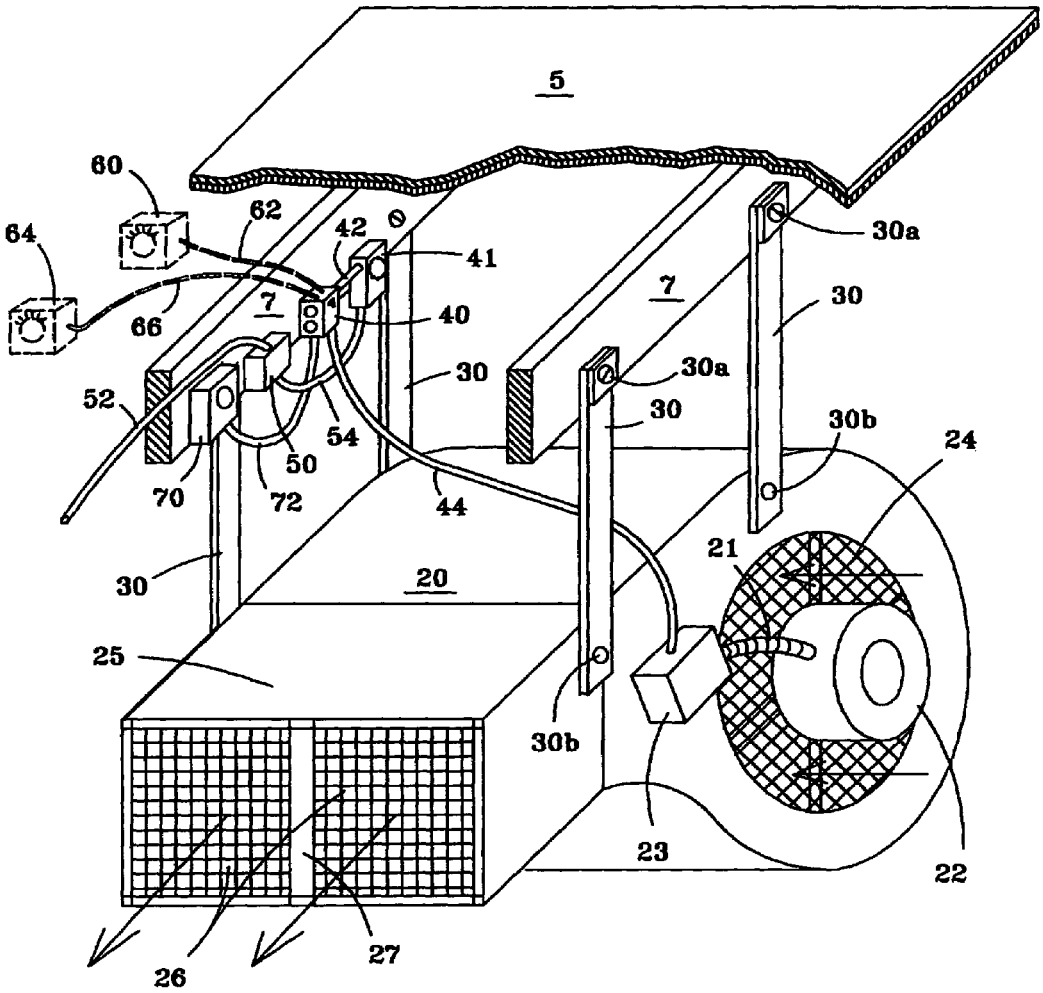
FIG. 2A is a perspective view of a fan unit suspended from a typical floor system of the building using flexible straps and including a power supply, sensors and a timer unit connected to a controller unit for operating the crawl space ventilation system.

A detailed view of the working components of one setup for the ventilation system for a building crawl space is illustrated in FIG. 2A. A fan unit 20 is suspended within the crawl space below the building floor 5 from floor structural members 7 using flexible straps 30. The straps are attached at the top to the floor members using fasteners 30*a* and at the bottom to the fan unit by fasteners 30*b*. This suspension means allows the fan unit to operate without structural vibrations and noise.

Figure 2B:
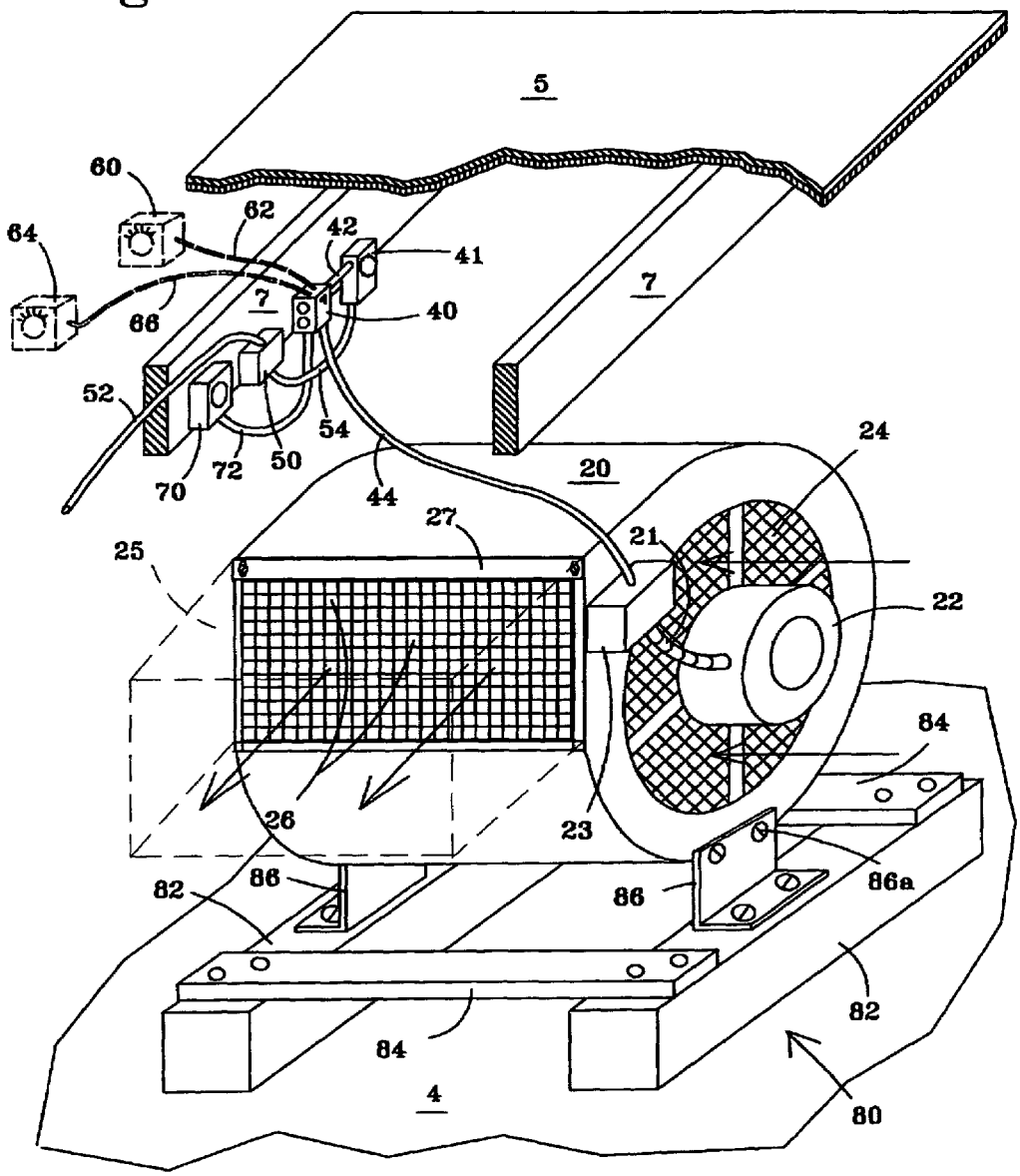
FIG. 2B is a perspective view of a fan unit sitting on the ground under the floor system of the building a support frame and including the power supply, sensors an the timer unit connected to the controller unit for operating the crawl space ventilation system.

A detailed view of the working components of another setup for the ventilation system for a building crawl space is illustrated in FIG. 2B. Fan unit 20 is supported above a ground surface 4 within the crawl space below the building floor 5 using a support frame 80. The support frame includes main support members 82 held together by cross members 84. Support brackets 86 are affixed to the main support members for holding and supporting the fan unit above the ground using fasteners 86*a*. The fan unit can alternately be made without a plenum 25 if a duct to serve a remote crawl space is not needed.

Once again, the fan unit includes a fan motor 22, inlet grills 24, a discharge plenum 25, and an outlet grill 26, as illustrated in FIGS. 2A and 2B. A timer unit 41 is connected to a controller 40 to activate fan motor 22 at periodic predetermined time intervals to move the crawl space air through the fan unit. An inlet grill 24 is provided on at least one side of the fan unit pulls air into the fan unit from the crawl space and an outlet grill 26 is provided for discharging air from a discharge plenum 25 back into the crawl space, as indicated by the arrows in FIGS. 2A and 2B. An outlet baffle 27 associated with the outlet grill of the fan unit provides back pressure in the discharge plenum so that the fan unit operates at a desired speed and power rating. A power cable 52 is brought from the building electrical power system into the crawl space to the fan unit. The power cable is first terminated in a power receptacle 50, located near the fan unit, to be further extended to a timer device 41 through a system cable 54. When the timer device is requesting the fan unit be turned on, electrical power is transmitted through a timer conduit 42 to a controller unit 40. The controller unit contains logic control circuits to decide if further conditions are satisfied to allow the fan unit to be operated. A previously discussed, these conditions may include the existing percent moisture in the crawl space, the percent moisture in the outside ambient air and the temperature in the crawl space. For convenience, the power receptacle, the timer device and the controller unit can be located near the fan unit.

To determine the conditions of the outside ambient air, exterior humidity sensor 60 is monitored. A low voltage signal is transmitted to the outside humidity sensor through sensor cable 62 and a second electrical signal is returned to indicate the percent moisture of the outside ambient air measured by the outside humidity sensor. To determine the conditions of the inside crawl space air, interior humidity sensor 64 is monitored. A low voltage signal is transmitted to the inside humidity sensor through sensor cable 66 and a second electrical signal is returned to indicate the percent moisture of the inside crawl space air measured by the inside humidity sensor. Logic control circuits in controller unit 40 are used to operate the fan unit when considering humidity values (percent moisture) and temperature (degrees) in the present ventilation system. This operation will be discussed later.

If the decision from the controller is to operate the fan unit, electrical power is allowed to flow from controller 40 through fan cable 44 to a fan connector box 23. Power is further transmitted to the electrical fan motor 22 through the motor conduit 21 to ventilate the crawl space.

Figure 3:
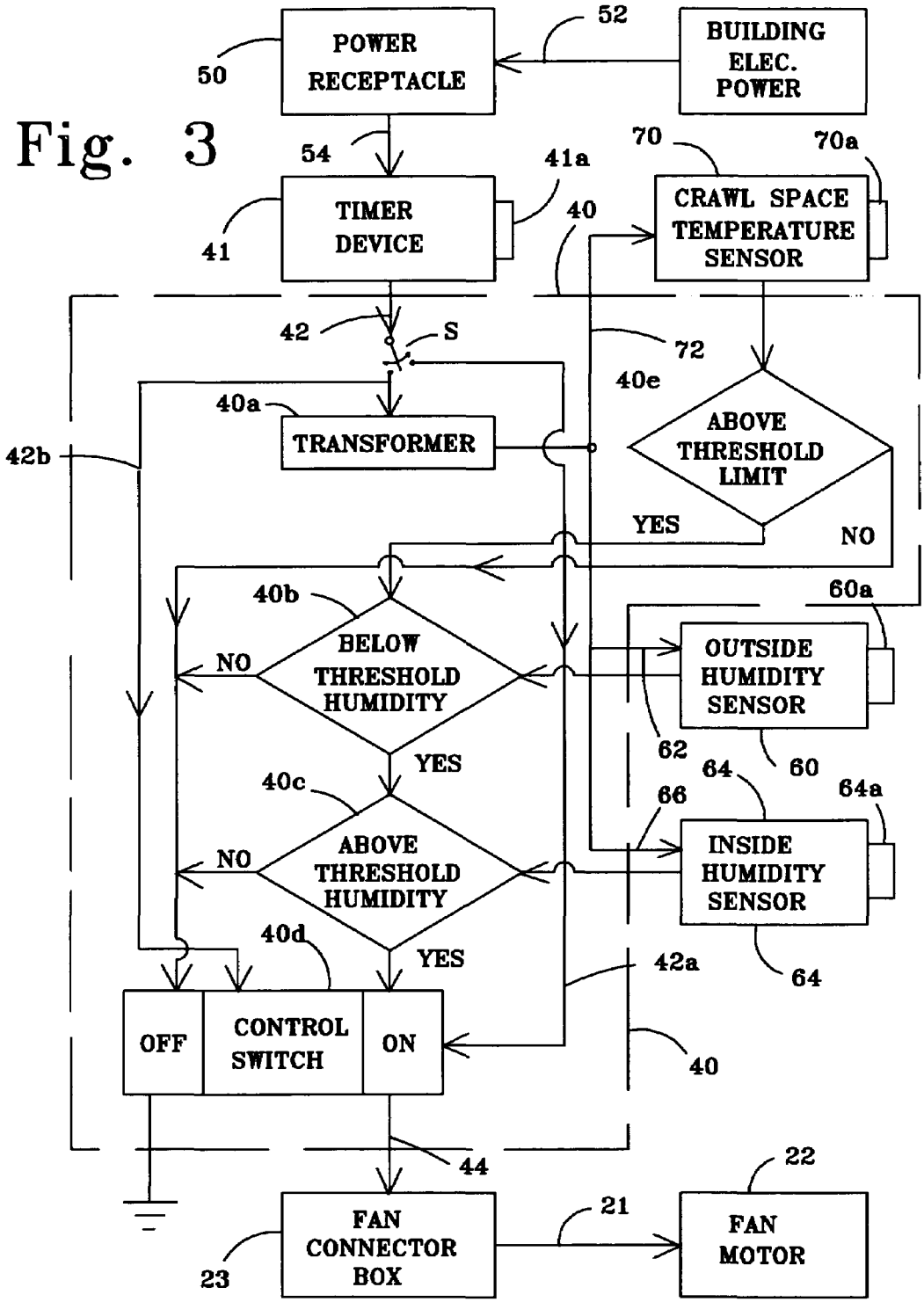
FIG. 3 is a flow diagram of how the crawl space ventilation components are interconnected and how the controller logic circuits of the controller unit function for periodic operation of the fan unit to provide proper ventilation subject to predetermined threshold humidity and temperature limits.

A flow diagram of the crawl space ventilation system is shown in FIG. 3. The building electrical power is transmitted through power cable 52 to power receptacle 50 located near the fan unit. System cable 54 transmits power directly to timer device 41. Operating parameters are set within the timer device using the timer dial 41*a* to adjust how often the fan should be turned on and the amount of time to operate the fan unit each operating interval. A nominal operating time may be to turn on the fan unit each hour for about 15 minutes. Depending on the layout of the crawl space and the moisture conditions within the crawl space the timer device can be set to operate more or less than the nominal conditions. Each installation will need to be evaluated as to what is optimum depending on the amount of air circulation achieved by the fan unit, the amount of excess moisture normally present within the crawl space and the building location and nominal outside environmental conditions, including wind direction and average velocity. Test installations have indicated that little change is needed once the general layout of the crawl space, existing moisture problems and the location of the building and surrounding structures are all accounted for.

If the timer device sends a first electrical signal indicating the fan unit should be turned on, power is transmitted to controller unit 40 through timer conduit 42 to the main control switch "S". The main control switch is used to select whether temperature and humidity conditions will be used or not to operate the fan unit. With the switch in a first position, the temperature and humidity sensors are bypassed and electrical power is transmitted directly through cable 42*a* from main switch S to turn on the control switch. Power is further transmitted through fan cable 44 to fan connector box 23 and fan motor 22 through motor conduit 21 to turn on the fan unit. If the switch is in a second position, the inside temperature, outside humidity and the inside humidity will be monitored to determine if existing temperature and moisture conditions outside and inside the crawl space are within limits for optimum operation of the fan unit. Electrical power is transmitted through timer cable 42*b* to control switch 40*d* which can be turned on or off by the logic control circuits 40*b* and 40*c* of the controller unit. Power is transmitted directly to a transformer 40*a* to produce the low voltage electrical power for the temperature and humidity monitoring circuits. The temperature and humidity monitoring circuits use low voltage sensors and components to transmit temperature, second and third electrical signals to and from temperature and humidity sensors 60, 64 and 70.

If the crawl space temperature is too low the advantages of circulating air within the crawl space may be limited. A crawl space temperature sensor 70 is used to help protect the system from freezing conditions which may cause ice to form in the crawl space and damage other components within the crawl space. The temperature sensor receives a low voltage signal through sensor cable 72 and transmits back to the controller unit a temperature signal for the crawl space air. A logic control circuit 40*e* of the controller unit compares the crawl space temperature with a predetermined low threshold temperature for safe operation of crawl space fan unit. The predetermined threshold temperature is set by temperature sensor dial 70*a*. If the temperature of the crawl space air is above the low threshold temperature the fan unit can operated. If the crawl space air is below the threshold limit value, control logic circuit 40*e* tells control switch 40*d* to terminate any power from being transmitted beyond the control switch. For example, if the crawl space temperature is below freezing, the circulation of air in the crawl space may cause ice to form and build on electrical equipment and other components.

If the outside humidity is too high the advantages of drawing outside air into the crawl space are diminished. In addition, if the humidity inside the crawl space is already low at a particular time, it may not be economical to ventilate the crawl space at that time. Humidity logic control circuits 40*b* and 40*c* allow these two conditions to be checked and the crawl space ventilation system to be turned off during the time it would normally be operating.

Outside humidity sensor 60 receives a low voltage first electrical signal through sensor cable 62 and transmits back to the controller unit a percent moisture signal for the outside air. The logic control circuit 40*b* of the controller unit compares the outside humidity with a predetermined high threshold humidity value acceptable for continuing to ventilate the crawl space. If the humidity of the outside air is below this high value, the fan unit can be operated. However, if the outside air is above this high value, first logic control circuit 40*b* tells control switch 40*d* to terminate any power from being transmitted beyond the control switch. For example, if it is raining outside, it would not be helpful to bring this 100 percent moisture content air into the crawl space. The high threshold limit value can be set by either a dial on the controller or a sensor dial 60*a* on the humidity sensor, as shown in FIG. 3.

Inside humidity sensor 64 receives a low voltage first electrical signal from sensor cable 66 and transmits back to the controller a percent moisture signal for the air inside the crawl space. The second control logic circuit 40*c* of the controller compares the inside humidity with a predetermined second threshold limit value acceptable for continuing to ventilate the crawl space. If the humidity of the air inside the crawl space is above this relatively low value, the fan unit will be operated. However, if the moisture content of the crawl space air is below this second threshold limit value the control logic circuit 40*c* tells control switch 40*d* to terminate any power from being transmitted beyond the control switch. For example, if it is a time of very low humidity, say 20 percent indicating the crawl space ventilation system has been working well, it may not be economical to bring this 20 percent moisture content air in the crawl space any lower. The system can actually bypass some operating cycles when it would normally be ventilating the crawl space. If both the outside air has a moisture content below a high value and the inside air has a moisture content above a low value, the control switch 40*d* is turned on and power is again delivered to fan motor 22 and the crawl space is ventilated.

Figure 4:
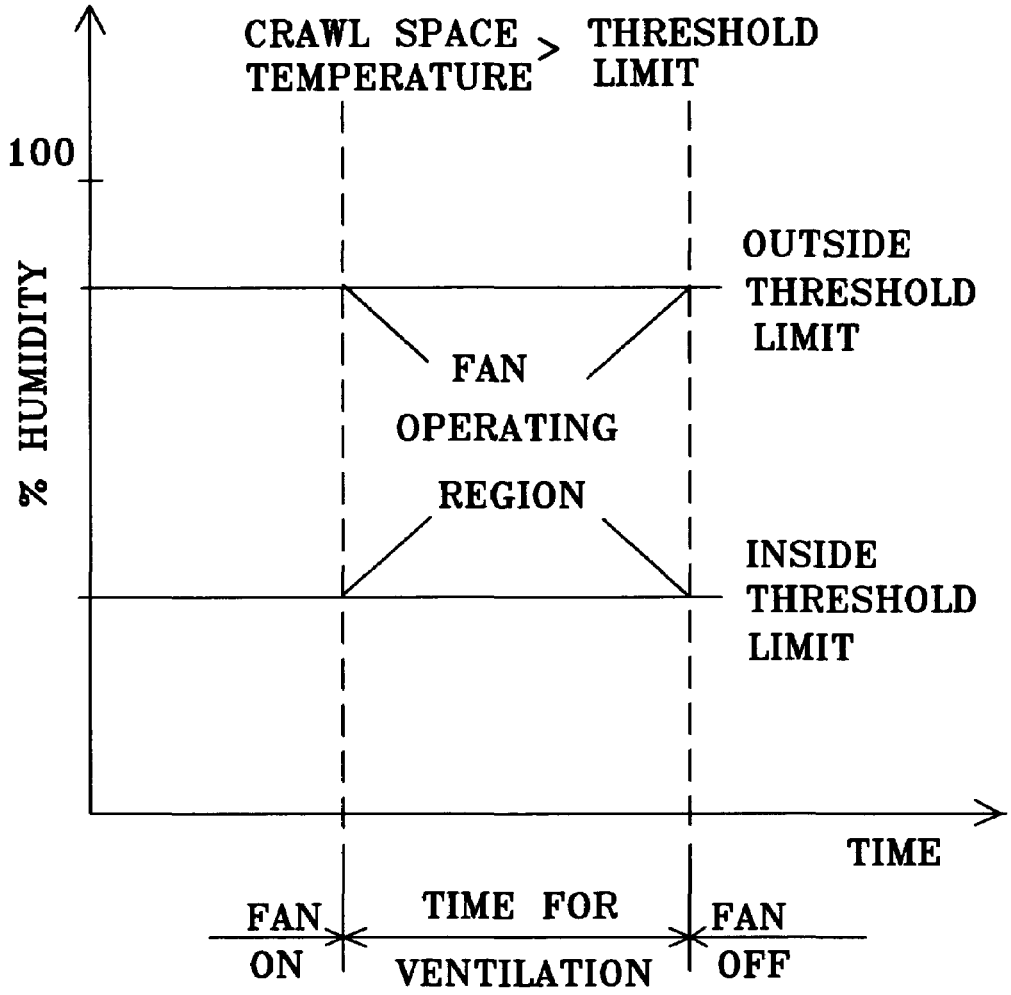
FIG. 4 is a graphic chart of the threshold humidity limits levels in relation to the fan operating time showing the fan operating regime when applying inside and outside humidity limits and when the crawl space temperature is greater than a threshold limit for temperature.

Operation of the system with humidity sensors 60 and 64 limiting on-time for the fan unit is illustrated in the graph of FIG. 4. During the time for ventilation set by the timer device, when the fan motor is to be turned on and before it is to be turned off, the fan unit is normally operating to ventilate the crawl space if the temperature of the crawl space is above a threshold temperature value. However, if main switch S of the controller is in a position to consider existing temperature and humidity conditions, the fan unit may be turned off. With an acceptable outside first threshold limit value for the humidity of the ambient air established and set by sensor dial 60*a*, the fan unit only operates when the outside humidity is below this value. With an acceptable inside second threshold limit value on the humidity of the crawl space air established and set by sensor dial 64*a*, the fan unit only operates when the crawl space humidity is above this second threshold limit value. These two limiting conditions defines a fan operating region, as illustrated in the graph of FIG. 4. When conditions exist within this operating region the crawl space will be ventilated; provided the crawl space temperature is above the temperature threshold limit.

It is possible to operate the ventilating system with only outside ambient air humidity being a factor by simply setting the inside threshold limit to zero and the temperature threshold limit is at a very low value. The ventilating system will then operate considering the timer device and ambient air humidity conditions only. In a similar mode, it is possible to operate the ventilating system with only inside crawl space air humidity being a factor by simply setting the outside threshold limit to 100 percent and again setting the temperature threshold limit at a very low value. The ventilating system will then operate considering the timer device and crawl space air humidity conditions only.

The ventilation system can also be made to be controlled by crawl space air temperature alone with the timer unit. The humidity threshold values can both be set to always allow the control switch to be turned on. If the inside humidity threshold limit is set to zero percent and the outside humidity threshold limit is set to 100 percent, the humidity conditions will not become a limiting factor and temperature logic control circuit 40*e* governs the operation of the ventilation system along with the timer unit.

Once again, there are other considerations beside the air temperature and moisture content to consider. The advantages of circulating air within the crawl space are important in removing radon gas concentrations and in removing moisture from damp surfaces that may rust of otherwise be damaged by moisture. The recommended method for radon gas is to provide a ground cover of polyethylene sheeting with a plumbing tee beneath the sheeting having a vent pipe through the sheeting and up through the roof. The vent pipe would not need to be extended through the roof with the present ventilating system as the air is being removed from the crawl space.

While a preferred embodiment of the invention has been described using specific terms, such description is for illustrative purposes only, and it is to be understood that changes and variations may be made without departing from the spirit or scope of the following claims.

What is claimed is:

1. An electrically powered ventilation system for a building crawl space to reduce the moisture content of enclosed air within walls of the crawl space, said system comprising:

a fan unit having a fan operated by an electrical motor, said fan unit centrally located and orientated within the crawl space;

said fan unit includes at least one inlet grill and an outlet grill for moving air within the crawl space through said fan unit to establish relatively high and low air pressure areas within the crawl space relative to the outside ambient air pressure;

inlet vents in the walls adjacent to low air pressure areas allow for movement of relatively low moisture content outside ambient air into the crawl space;

outlet vents in the walls adjacent to high air pressure areas allow for movement of relatively higher moisture content crawl space air to be discharged from the crawl space;

a timer unit manually set to transmit a first electrical signal to activate said fan unit for ventilation periodic time periods that are set to optimally reduce the moisture content of the crawl space air;

a controller unit having a control switch is connected between said timer unit and said fan unit to turn the fan unit on and off; and a main switch of said controller unit for directly transmitting electrical power to said control switch to turn on said fan unit in one position, and to activate control logic circuits for air temperature and humidity controls before selectively transmitting electrical power to said control switch to turn on said fan unit in the other position.

2. The ventilation system of claim 1 including:

a transformer of said controller unit to provide a low voltage signal;

a crawl space temperature sensor powered by said low voltage signal to sense the crawl space temperature and transmit a temperature signal to indicate the crawl space temperature; and a temperature control logic circuit of said controller unit that receives both said low voltage signal and said temperature signal, wherein said low voltage signal is transmitted directly to said control switch to turn the fan motor off when said temperature signal is below a predetermined temperature value.

3. The ventilation system of claim 2 including:

an outside humidity sensor powered by said low voltage signal, to sense the percent moisture content of the outside ambient air and transmit a second electrical signal to indicate the outside air humidity; and a first control logic circuit of said controller unit that receives both said low voltage signal and said second electrical signals, wherein said low voltage signal is transmitted directly to said control switch to turn the fan motor off when the outside humidity is above a first threshold value.

4. The ventilation system of claim 1 including:

an inside crawl space humidity sensor powered by said low voltage signal to sense the percent moisture content of the inside crawl space air and transmit a third electrical signal to indicate the inside crawl space air humidity; and a second control logic circuit of said controller unit that receives both said low voltage signal and said third electrical signal, wherein the low voltage signal is transmitted directly to said control switch to turn the fan motor on when the inside crawl space humidity is above a second threshold value and to turn the fan motor off when the inside crawl space humidity is below a second threshold value.

5. The ventilation system of claim 1 wherein the crawl space includes a remote crawl space such that the ventilation system further comprises:

a discharge plenum of the fan unit;

a duct to extending from said discharge plenum into the remote crawl space, wherein a portion of the discharge air from the discharge plenum of said fan unit is diverted and discharged into the remote crawl space to produce an increase in the air pressure within the remote crawl space;

remote outlet vents for movement of relatively high moisture content within the remote crawl space to the exterior of the remote crawl space, wherein the air pressure in the crawl space is reduced to a balanced air flow.

6. The ventilation system of claim 1 including:

flexible straps attached to and extending from floor structure of the building for supporting the fan unit and limit the amount of noise and vibrations produced by operating the fan and fan motor.

7. The ventilation system of claim 1 including:

a support frame setting on a ground surface for supporting the fan unit within the crawl space to limit the amount of noise and vibrations produced by said fan unit, said fan and said electrical motor.

8. The ventilation system of claim 7 wherein said support frame includes:

main support members resting on the ground surface;

a pair of cross members connecting said main members together as a unit; and a pair of support brackets affixed to said main support members to support and hold said fan unit within the crawl space.

9. The ventilation system of claim 1 including an outlet baffle associated with said outlet grill of said fan unit to provide a back pressure in said discharge plenum so that said fan motor will operate at a desired speed and power rating.

10. A multiple ventilation system for multiple crawl spaces under a building structure with exterior wall vents to reduce the moisture content of the air within at least one crawl space, said multiple ventilation system comprising:

a fan unit having a fan operated by an electrical motor centrally located and orientated within said at least one crawl space;

a timer unit associated with fan unit that is set to transmit a first electrical signal for ventilation time periods that are determined to optimally reduce the moisture content of the air in a respective crawl space;

a temperature sensor to determine a temperature within the at least one crawl space and transmit a temperature electrical signal that generally indicates a temperature value in the crawl space used to determine if said fan unit should be activated;

an outside humidity sensor to determine the percent moisture value of the ambient air and generate a second electrical signal to indicate the ambient air moisture value to further determine if said fan unit should be activated;

an inside humidity sensor to determine the percent moisture value of the at least one crawl space air and generate a third electrical signal to indicate a percent moisture value for the at least one crawl space air to also help determine if said fan unit should be activated; and a controller unit associated with each crawl space having a main switch, a transformer, a plurality of logic control circuits and a control switch that receives said temperature, second and third electrical signals and compares these signals with predetermined limits of temperature and humidity, whereby the fan unit may be activated.

11. The multiple ventilation system of claim 10 wherein said fan unit includes at least one inlet grill, an outlet grill and an outlet baffle for moving air within the at least one crawl space through said fan unit to establish relatively high and low pressure areas within the at least one crawl space, so that air flows in and out of the at least one crawl space through respective exterior wall vents.

12. The multiple ventilation system of claim 10 wherein said controller unit includes a main switch wherein electrical power is transmitted directly to said control switch to activate the fan motor when said main switch is in one position and said transformer and logic control circuits are activated when said main switch is in a second position.

13. The multiple ventilation system of claim 10 wherein said plurality of logic control circuits includes a temperature logic control circuit for comparing said temperature electrical signal of said crawl space air moisture value with a predetermined temperature threshold limit value, wherein said control switch is free to activate the fan motor when the crawl space air temperature is above the temperature threshold limit value and turns the fan motor off when the crawl space air temperature is below the temperature threshold limit value.

14. The multiple ventilation system of claim 13 wherein said plurality of logic control circuits includes a first logic control circuit for comparing said second electrical signal of said outside air moisture value with a predetermined first threshold limit value, wherein said control switch is free to activate the fan motor when the outside ambient air humidity is below the first threshold limit value and turns the fan motor off when the outside ambient air humidity is above the first threshold limit value.

15. The multiple ventilation system of claim 14 wherein said plurality of logic control circuits includes a second logic control circuit for comparing said third electrical signal of said crawl space air moisture value with a predetermined second threshold limit value, wherein said control switch activates the fan motor when the inside crawl space air humidity is above said second threshold limit value and turns the fan motor off when the inside crawl space air humidity is below the second threshold limit value.

16. The multiple ventilation system of claim 10 wherein the controller unit includes a transformer to reduce the first electrical signal to a low voltage signal used to power the humidity and temperature sensors and logic control circuits of the controller unit.

17. The multiple ventilation system of claim 10 wherein the at least one crawl space includes a remote crawl space of the multiple crawl spaces said remote crawl space system comprises:

a plurality of outlet vents associated with the exterior wall vents of said remote crawl space; and a duct extending from a discharge plenum of said fan unit into the remote crawl space, wherein a portion of the discharged air from said fan unit is diverted and discharged into the remote crawl space through said duct to produce an increase in the air pressure within the remote crawl space and move the relatively high moisture content air within the remote crawl space to the exterior of the remote crawl space through said outlet vents.

* * * * *